United States Patent [19]

Goodspeed

[11] Patent Number: 4,838,182

[45] Date of Patent: Jun. 13, 1989

[54] APPARATUS FOR REGULATING AIR FLOW THROUGH AN AIR PORT OF A CHEMICAL RECOVERY FURNACE

[76] Inventor: Byron L. Goodspeed, 1111 Holcomb Rd., Kelso, Wash. 98626

[21] Appl. No.: 199,126

[22] Filed: May 26, 1988

[51] Int. Cl.[4] ..... F23L 5/00

[52] U.S. Cl. ..... 110/182.5; 15/246; 110/297; 266/269

[58] Field of Search ..... 110/297, 309, 310, 314, 110/182.5; 431/121, 122, 123; 266/265, 266, 269; 15/246

[56] References Cited

U.S. PATENT DOCUMENTS 3,943,861 3/1976 Astrom et al. ..... 110/182.5

4,423,533 1/1984 Goodspeed ..... 15/246

4,545,308 10/1985 Zaterka ..... 110/297

4,759,299 7/1988 Kennedy et al. ..... 110/182.5 X

*Primary Examiner*—Edward G. Favors

*Attorney, Agent, or Firm*—Dellett, Smith-Hill & Bedell

[57] ABSTRACT

Removable apparatus for regulating air flow through an air port in a chemical recovery furnace. A plenum having an adjustable damper is mounted inside a wind box associated with the furnace adjacent to an air port and supplies and regulates the flow of air from the wind box to the furnace through the air port. A metal cleaning head having a cage-like configuration is pivotally mounted in a retracted, at-rest position inside the plenum above and adjacent to the air port so as not to interfere with movement of the adjustable damper.

7 Claims, 4 Drawing Sheets

APPARATUS FOR REGULATING AIR FLOW THROUGH AN AIR PORT OF A CHEMICAL RECOVERY FURNACE

BACKGROUND OF THE INVENTION

The present invention relates to furnaces and particularly to improved apparatus for regulating air flow through a port introducing combustion air into the firebox of a furnace and including apparatus for automatically cleaning the air port.

Wood pulp for papermaking is usually manufactured according to the sulfate process wherein wood chips are treated with a cooking liquor including sodium sulfide and sodium hydroxide. The wood chips and the cooking liquor, called "white liquor," are cooked in a digester under predetermined heat and temperature conditions. After cooking, the used liquor, termed "black liquor," containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries and melts the spent cooking chemicals as they fall to the floor of the firebox, where they build a mound of material called a char bed. The char bed is further heated to further liquefy the chemicals into a molten smelt that flows out of the furnace through a smelt spout to a collection tank. Concurrently, combustion heat is employed to generate steam in a water wall of the boiler for use as process steam and for generating electricity.

The combustion process requires the introduction of large volumes of air into the firebox, air comprising about 80 percent of the material entering the furnace. The combustion air is distributed by means of wind boxes or ducts disposed at several levels in surrounding relation to the firebox and outside the walls of the furnace. The air is forced into the firebox from the wind boxes through a plurality of passages or air ports in the walls of the furnace, viz.: primary, secondary and tertiary air ports. The primary air ports, through which about 40 to 50 percent of the air enters the furnace, are disposed on the side walls of the firebox near the bottom of the furnace and close to the char bed. The air supplied to the primary air ports is at a comparatively low pressure in order to promote a reducing atmosphere in the burning mass of char. The secondary air ports, which are fewer in number than the primary air ports and through which about 35 percent of the air enters the furnace, are disposed around the walls of the firebox, higher than the primary air ports, and usually below the level of the entry conduits through which the black liquor is sprayed into the firebox. Air supplied through the secondary air ports is at a slightly higher pressure in order to promote burning of combustible gasses rising from the glowing mass of the char bed. While the primary air ports provide a relatively large volume of air with considerable turbulence for maintaining a fireball in the char bed, the secondary air ports are intended to provide a finer control and distribution of air above the char bed and distribute the air evenly in the black liquor spray to support the combustion thereof. Air is supplied through the tertiary air ports at a still higher pressure to promote combustion of gases rising through the firebox, the tertiary air ports being higher on the wall of the furnace than the secondary air ports.

The black liquor sprayed into the firebox, having a consistency like warm 60 weight oil, swirls, burns and falls toward the bottom of the firebox in the form of combustion products comprising char material and smelt. The smelt and char material contact and flow down the outer walls of the firebox and, cooled by the inflowing air, form excrescent deposits around edges of the air ports, particularly along the top edges of the secondary air ports where the excrescent material builds up and outward under influence of air rushing through the secondary air port. Such buildup of char material can block air flow through a port by as much as ten percent. Therefore, furnace operation tends to be inefficient and unpredictable with an attendant decrease in the amount of chemicals that can be recovered, a decrease in the amount of steam produced per unit of fuel, and increased emission of noxious gases such as hydrogen sulfide, carbon monoxide and sulfur dioxide. In accordance with customary practice, the char buildup is periodically removed either by manually inserting a cleaning rod into the air ports successively around the boiler or by actuating mechanized cleaning apparatus mounted in the air ports. With the passage of time, and particularly when cleaning is effected by manual rodding of the air ports, gradual buildup of char material intermittently around the furnace can cause changes in the volume of combustion air, as well as changes in air distribution, velocity and pressure The volume and distribution of combustion air supplied to the furnace will also vary depending on the load of the furnace and the moisture content of the liquor being reduced. The distribution and volume of air entering a furnace is conveniently adjusted by regulating means such as dampers provided in supply conduits of the wind boxes. Dampers may also be provided at various locations in the wind boxes, and individual air ports may furthermore be provided with a damper, thus making possible a selective distribution of air within each wind box, or in each wind-box passage or each air port, respectively, thereby maintaining the desired air supply in all parts of the furnace.

Separate apparatus for cleaning openings in a recovery furnace are known. See, for example, my U.S. Pat. No. 4,423,533 entitled FURNACE AIR PORT CLEANER. Apparatus combining the function of air-port cleaning and air-flow damping are also known; however, such dual purpose apparatus have been found to have certain disadvantages in that either the air damping or the cleaning is unsatisfactory. Cleaning apparatus designed to be effective for that purpose, when used as a damper, may be subjected to excessive heat from the furnace and deteriorate rapidly. My copending application Ser. No. 829,712, now U.S. Pat. No. 4,748,004, discloses a cleaning head for use in secondary air ports that may be employed also as a damper to control the flow of combustion air through the air port. For this purpose, the cage-like structure of the cleaning head is enclosed, and the mounting frame is partially or completely enclosed or walled in, so that, for a given position of the cleaning head, air flow tends to be closed off. The position of the cleaning head may be varied to accomplish cleaning or to effect a different air flow. It has been found that a cleaning element utilized as a damper partially or fully blocking an air port, i.e., extending into the air port, often is subjected to excessive heat from the furnace. It is thus desirable to employ a separate damper that is disposed near, but spaced apart some distance inside the wind box from the air-port opening.

On the other hand, a device designed to function effectively as a damper, when extended into the air port for cleaning the same, often proves to be ineffective for that purpose because the shape of the damper is not conducive to cleaning the opening. Accordingly, separate air damping and air-port cleaning apparatus are desirable over dual purpose devices because more uniform and stable air flow is maintained through the air ports, resulting in more efficient operation of the furnace.

A damper that controls the air flow to a particular air port ordinarily is located near the air port, and consequently may interfere with the operation of separate automatic cleaning apparatus installed in the air port. If unlimited space were available, a damper could be installed upstream of the cleaning apparatus in the passage supplying air to the air port; however, space adjacent to an air port for installing such apparatus is often limited and constructing such additional space is costly. Further, when a damper is retracted or moved out of the way of cleaning apparatus, it is often necessary to position the damper such that air flow through the passage to the air port is blocked, which is undesirable because without positive air pressure outside the air port, effluent from the furnace could enter the air duct and foul or damage the mechanisms.

It is accordingly a primary object of the present invention to provide improved apparatus for regulating the flow of combustion air in a chemical recovery furnace.

It is another object of the present invention to provide improved air regulating apparatus installable in an air port of a chemical recovery furnace and including air-port cleaning apparatus that operates cooperatively with a damper mechanism.

Another object of the present invention is to provide improved air regulating apparatus including air port cleaning apparatus for increasing the operational stability of a black liquor recovery boiler.

It is a further object of the present invention to provide improved air regulating apparatus operating in concert with air port cleaning apparatus for enhancing the efficiency of chemical recovery, increasing steam production, and reducing sulfur dioxide and carbon monoxide emissions from a black liquor recovery boiler.

SUMMARY OF THE INVENTION

According to the present invention, in a preferred embodiment thereof, a furnace air port is provided with apparatus including an adjustable damper and a cleaning head pivotally mounted in a plenum adjacent to the port, the cleaning head being adapted for automatic insertion into the air port and partially inside the firebox vertically beyond an edge of the air port to dislodge excrescent material built up on the edge. Means are provided for retracting the damper out of the way of the cleaning head and moving the cleaning head into the air port during a cleaning cycle and subsequently retracting the cleaning head and repositioning the damper after cleaning has been accomplished.

In another embodiment according to the present invention, the cleaning head is constructed as a metal frame substantially the size of the air port, so as to sweep along all the edges of the air port when inserted therein to dislodge excrescent material or char buildup therefrom. The posterior side of the frame is closed such that, in the retracted position, the posterior surface of the cleaning head serves as a closure of an opening in the top of the plenum chamber, and when the cleaning head moves away from the retracted position during a cleaning cycle, air flows through the opening into the air port providing a blowing action that augments cleaning and cools the cleaning head.

In accordance with a particular embodiment of the invention, shield plates are provided on the cleaning apparatus for insertion into the air port to protect boiler tubes located inside the furnace from damage due to contact by the moving cleaning head.

The apparatus according to the present invention is easily removable from the air port. In particular, the apparatus is affixed to a plate which is attached to a flange on the external wall of the wind box. For repair or servicing, the apparatus according to the present invention is thus easily removed from the wind box.

The apparatus according to the instant invention is suitably operated at regular intervals on an automatically timed basis so as to keep the air port substantially clear of excrescent material and without interfering with air flow damping, which results in improved stability of furnace operation. Consequently, more efficient recovery of chemicals is realized, as well as an increase in steam production and decrease in the emission of pollutant gasses. While only a single apparatus according to the present invention is illustrated and described herein, it is understood that a plurality of such apparatus are ordinarily disposed around a particular firebox so as to clean a comparatively large number of air inlets. The separate apparatus can be operated either sequentially or simultaneously.

DRAWINGS

While the invention is set forth with particularity in the appended claims, other objects, features, the organization and method of operation of the invention will become more apparent, and the invention will best be understood by referring to the following detailed description in conjunction with the accompanying drawings, in which:

DESCRIPTION OF THE PREFERRED EMBODIMENT

Figure 1:
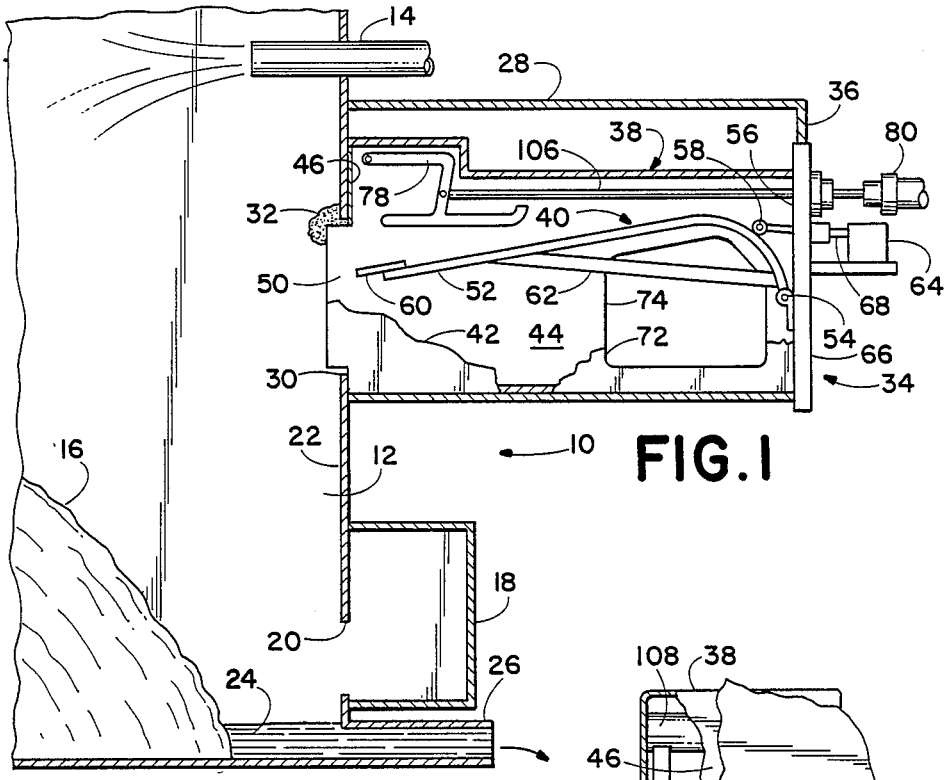
FIG. 1 is a schematic view of a portion of a black liquor recovery boiler of a type with which the present invention may be employed, and showing one embodiment of the invention installed therein.

Referring now to the various views of the drawing for a more detailed description of the construction, function, operation and other features of the instant invention by characters of reference, FIG. 1 shows a black liquor recovery boiler 10 which comprises a firebox 12 of a steam boiler. Black liquor is sprayed through a conduit 14 into the firebox 12, where the organic materials in the black liquor are ignited, the chemicals and combustion products being deposited on the floor of the firebox as a char bed 16. A first wind box 18 substantially surrounds the firebox 12 and delivers combustion air under pressure into the firebox through a plurality of primary air ports 20 formed in the wall 22 of the firebox 12 around the periphery thereof at the level of the char bed 16 to maintain a fireball in the char bed. A molten chemical-containing smelt 24 is recovered from the burning char bed 16 through smelt spouts 26 disposed in the bottom of the firebox 12, the smelt being collected for further treatment.

A second wind box 28 substantially surrounds the firebox 12 and delivers combustion air under pressure into the firebox through a plurality of secondary air ports such as air port 30 formed in the wall 22 of the firebox 12 around the periphery thereof above the char bed 16 and below the level of the black liquor entry conduit 14 for supporting the initial combustion of the organic materials in the black liquor. As previously described herein, excrescent material 32 comprising hardened smelt and char material forms on the walls 22 of the firebox, particularly above the edges of the secondary air ports 30, as illustrated in FIG. 1.

Referring now to FIGS. 1–4, in accordance with the present invention, apparatus 34 for regulating the flow of air into the air port 30 is installed in the second wind box 28 and attached to an outer wall 36 of the wind box 28, and comprises a plenum chamber 38 in which an adjustable damper 40 is mounted for controlling the flow of air through the plenum chamber 38 to the air port 30. The plenum chamber 38 is constructed of sheet metal in the form of an enclosed, generally rectangular duct having substantially parallel side walls 42, 44 spaced apart by a distance corresponding with the width of the air port 30. An end wall 46 of the plenum chamber 38 is provided with an opening 48 substantially the size of the air port 30, and includes lateral plates 50 formed by extensions of the side walls 42, 44 of the plenum chamber 38, the lateral plates 50 extending through the air port 30 on either side thereof and into the firebox 12. Upon installation of the plenum chamber 38 into the wind box 28, the lateral plates 50 guide the plenum chamber 38 into the air port 30 and serve to protect boiler tubes (not shown) from damage by moving parts of the installed apparatus 34, as explained hereinafter.

Figure 2:
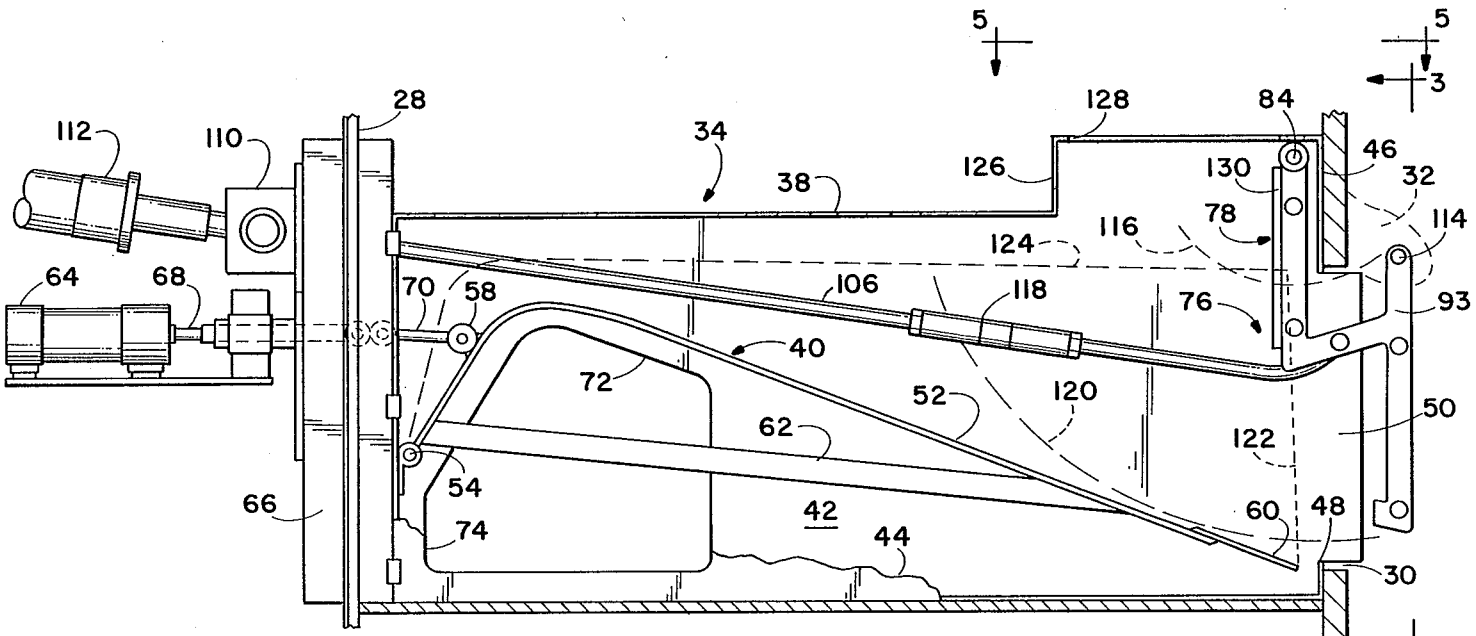
FIG. 2 is a side elevation view, partially cut away, of apparatus according to the instant invention, and showing the damper in a closed position and the cleaning head extended.

The near side wall of the plenum chamber 38, as viewed in both FIGS. 1 and 2, is shown cut away to reveal the apparatus mounted inside the plenum chamber. In the presently described embodiment of the invention, the adjustable damper 40 comprises an oblong, flat and generally L-shaped blade 52 made of sheet metal and having a width slightly less than the interior width of the plenum chamber. The proximal end of the damper blade is attached by a pivot 54 to the end wall of the plenum chamber remote from the opening 48, while an elongate portion of the damper blade extends substantially the length of the plenum chamber 38 from a clevis 58 affixed as by welding near the proximal end to a tip 60 at the distal end of the damper blade 52, the tip 60 being disposed in the air passage close to the opening 48. The tip 60 of the damper blade 52 is suitably made from a short length of heat resistant metal such as stainless steel. A stiffening member 62 is welded between the distal and proximal ends of the L-shaped damper blade 52. A damper actuating mechanism comprises an air operated cylinder 64 attached to a mounting plate 66 of the plenum chamber externally of the wind box 28, and includes an actuating rod 68, which extends through the plate 66 and connects pivotally to a connecting rod 70, which in turn is attached by a pin to the clevis 58 welded to the damper blade 52. Other motive means such as a servomotor or a manual crank-driven worm drive may be used instead the pneumatic cylinder shown to change the position of the damper blade. Openings 72, 74 disposed below the crook of the L-shaped damper blade in the side walls 42, 44 of the plenum chamber receive combustion air under pressure from the wind box 28. Air from the wind box 28 flows into the openings 72, 74 and through the plenum chamber 38 beneath the damper blade 52 and through the opening 48 into the firebox. The position of the damper blade 52 may be adjusted by moving the actuating rod 68 axially toward or away from the air port 30, thereby lowering or raising, respectively, the damper blade 52 in the plenum chamber to decrease or increase the flow of combustion air passing through the openings 72, 74 and into the air port 30. The damper blade may be lowered until the tip 60 is disposed at the bottom of or below the air port opening 48, substantially stopping air flow through the plenum chamber 38.

Air flow through the air port 30 is subject to attenuation by constriction of the opening 30 from buildup of excrescent material 32, therefore, according to the instant invention, apparatus 76 for cleaning the air port is mounted inside the plenum chamber 38. The cleaning apparatus 76 includes a cleaning head 78 pivotally mounted in a retracted position adjacent to the opening 48, as shown in FIG. 1, and motive means 80 mounted externally of the wind box and extending through the plenum for periodically operating the cleaning head 78.

Figure 4:
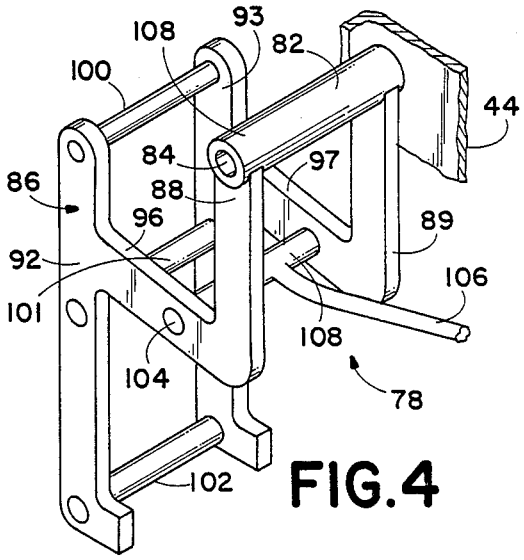
FIG. 4 is a perspective view of a cleaning head used in apparatus according to the present invention.
Figure 3:
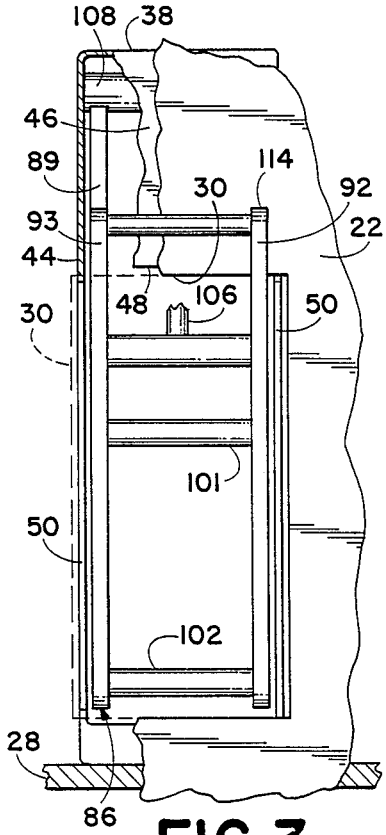
FIG. 3 is a view, partially cut away, taken along lines 3—3 of FIG. 2.

Referring still to FIGS. 1–4 and particularly to FIG. 4, the cleaning head 78 comprises a metal frame affixed as by welding to a cylindrical sleeve 82 pivotally mounted between the side walls 42, 44 of the plenum chamber to a pivot 84 passing through the sleeve 82, the pivot being attached to the side walls 42, 44. The primary cleaning feature of the cleaning head 78 is embodied in a hook-like implement 86 comprising a pair of arms 88, 89 affixed at proximal ends thereof to the sleeve 82, and cleaning members 92, 93 each depending by extensions 96, 97 from the corresponding arm 88, 89, the cleaning members 92, 93 being essentially parallel with the arms 88, 89. The cleaning members 92, 93 are spaced apart from each other in parallel relation by cross members 100–102, and the extensions 96, 97 by a trunnion 104 near their juncture with the arms 88, 89. An actuating rod 106 is rotatably attached to the trunnion 104 by a sleeve 108 to which the rod 106 is welded. The cleaning head 78 is suitably constructed of heat resistant metal such as stainless steel.

The actuating rod 106 is connected pivotally and slidably through a mounting assembly 110 to an actuating cylinder 112, preferably an air operated cylinder, for slidably advancing the rod 106 toward the air port 30. The cleaning head 78, is thus adapted to rotate about the pivot 84 and pass through the rectangular opening 48 into the air port 30 dislodging excrescent material 32 accumulated in the air port 30. As the cleaning head 78 is extended into and then withdrawn from the opening 48, the cleaning members 92, 93 sweep the peripheral edges of the air port 30. It will be observed that advancing the rod 106 swings the cleaning head 78 from the retracted position down and forwardly from the pivot 84 into the air port 30, the extended ends 114 of the cleaning members defining a locus indicated in FIG. 2 by the dashed line 116 wherein the cleaning members contact and dislodge the excrescent material 32. The rod 106 is provided with an adjusting means such as turnbuckle 118 for adjusting the length of the actuating rod 106 upon installation of the cleaning apparatus 34 in the plenum chamber 38.

FIG. 1 shows the cleaning head in a retracted position inside the plenum chamber 38 and the adjustable damper 40 in an open position wherein air flows through the damper into the air port, while FIG. 2 shows a cleaning cycle in process wherein the damper 40 is in a closed position and the cleaning head 78 is extended into the air port 30. It is seen in FIGS. 1 and 2 that the locus of movement of the cleaning head, as illustrated by the dashed semicircle 120, FIG. 2, is in mutually interfering relation with the locus of movement of the damper blade 52, shown by the dashed line 122, FIG. 2. The upper limit of movement of the damper blade 52, when the damper if fully open, is shown by the dashed line 124 in FIG. 2. Accordingly, upon initiation of a cleaning cycle, the damper blade is lowered from the open position to the closed position, which is outside the locus of movement 120 of the cleaning apparatus 76, and allows the cleaning head 78 to be actuated and moved into the opening 48 without interference from the damper blade 52.

Figure 5:
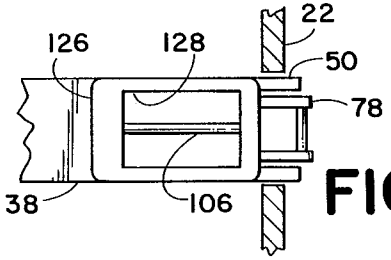
FIG. 5 is a view taken along lines 5—5 of FIG. 2.

FIG. 1 illustrates the cleaning head 78 in an at-rest or retracted position, withdrawn from the air port 30. It will be observed that the temperature inside the firebox is normally much hotter than in the plenum chamber 38 where the cleaning head 78 normally resides, due in part to the air flow through the plenum chamber, and consequently the cleaning head is protected to a degree from the excessive temperature of the firebox except for a brief period of use. When the damper blade is lowered to the position shown in FIG. 2, substantially no air flows through the openings 72, 74 into the plenum chamber 38 and positive pressure inside the plenum chamber with respect to the furnace is reduced. Referring to FIGS. 1, 2 and 5, a turret 126 is formed atop and at the end 46 of the plenum chamber 38. The cleaning head 78 moves into the recess formed by the turret and remains there in a retracted position between cleaning cycles, out of the way of the damper blade 52. An aperture 128 in the top of the turret 126 is blocked, when the cleaning head is retracted, by a closure 130 suitably made from a plate of sheet metal sized to fit the aperture 128 and attached as by welding to the cleaning head 78. Thus, when the damper is closed during a cleaning cycle, movement of the cleaning head away from the retracted position opens the aperture 128 to the wind box and air flow through the plenum chamber to the air port 30 is maintained.

At timed intervals, e.g. about every thirty minutes, a cleaning cycle is initiated automatically, and the cylinder 64 is actuated to lower the damper blade 52 to the closed position as shown in FIG. 2. The cylinder 112 is then actuated, swinging the cleaning head 78 into the air port 30 to the position as illustrated in FIG. 2. While the damper is closed and the cleaning head is in motion, air flows into the plenum chamber through an aperture, which is opened by movement of the cleaning head away from its retracted position. When the cleaning head 78 is fully engaged into the air port 30 the end 114 of the hook-shaped implement of the cleaning head 78 rises substantially above the upper edge of the air port while the cleaning members sweep substantially the entire cross sectional area of the opening. The cylinder 112 is then operated in the reverse direction for retracting the cleaning head 78 from the firebox back to its at-rest position, as shown in FIG. 1. The damper is then moved from its closed position to essentially the same position it occupied prior to initiation of the cleaning cycle, or to a new position commensurate with the amount of air flow required through the plenum chamber following removal of material that may have been blocking the air port.

Figure 6:
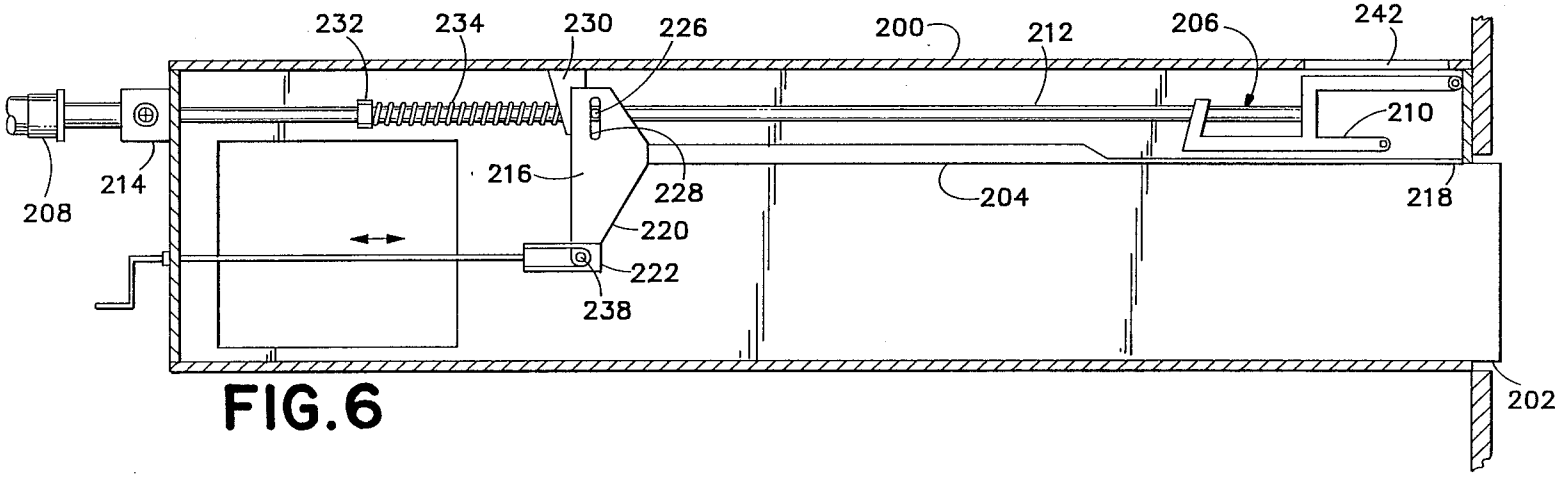
FIGS. 6–8 show an alternative embodiment of apparatus according to the instant invention.
Figure 7:
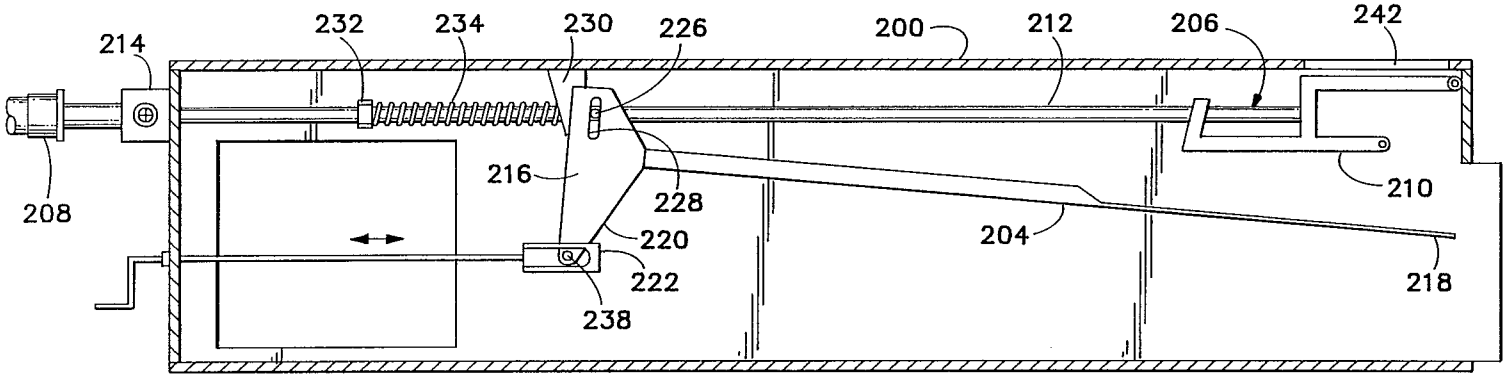
Figure 8:
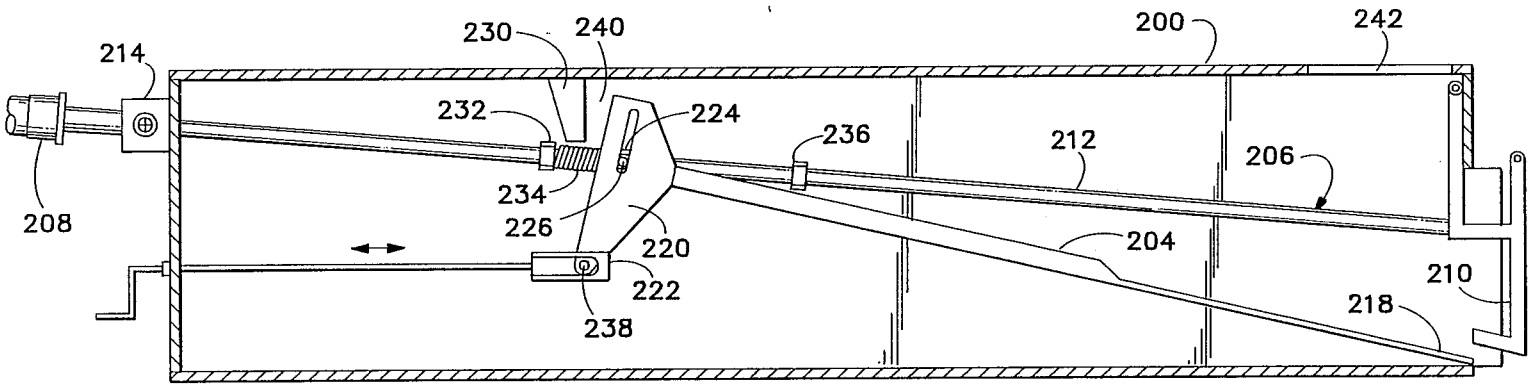

Referring to FIGS. 6–8, an alternative embodiment of apparatus according to the instant invention is shown. A plenum or duct 200 suitable for installation in a wind box, not shown, for regulating air flow into an air port 202 of a furnace, includes an adjustable damper 204, cleaning apparatus 206 and an actuating mechanism 208. The plenum 200 is shown in each of FIGS. 6–8 with the near side cut away to reveal the components mounted inside the plenum. The cleaning apparatus 206 includes a cleaning head 210, which is substantially identical with the cleaning head previously described with reference to FIGS. 1–4. An actuating rod 212, pivotally and slidably mounted through a mounting assembly 214 in the wall of the plenum, connects the cleaning head 210 to the actuating mechanism 208 which is preferably an air operated cylinder. The damper 204 is supported at a proximal end 216 thereof in cantilever fashion to allow upward or downward movement of the distal end 218 of the damper near the opening of the air port 202. The damper 204 is suitably made of sheet metal having a width slightly less than the interior width of the plenum to facilitate blocking air flow within the plenum while allowing vertical movement of the damper blade inside the plenum to regulate the air flow therethrough. The damper 204 is affixed as by welding at its proximal end 216 to a coupler 220, which is pivotally and slidably attached at its lower end to an adjustment track 222 affixed to a side wall of the plenum. The coupler 220 may suitably be constructed of metal plates so as to provide a closure of the plenum between the proximal end 216 of the damper and the top wall of the plenum 200. The coupler 220 is slidably coupled to the actuating rod 212 by way of a damper collar 224 which includes lateral pins 226 engaged in slotted apertures 228 in the sides of the coupler 220. The damper collar 224 is slidable axially along the actuating rod 212, but constrained from leftward movement, as viewed in the drawings, by a stop 230 attached as by welding in the top of the plenum 200. A first rod collar 232 affixed to the actuating rod 212 provides one seat for a coil spring 234 through which the rod 212 passes, while a second rod collar 236, also affixed to the rod 212, engages the damper collar 224 and holds it snugly against the stop 230, when the cleaning apparatus 206 is in the retracted position as shown in FIG. 6. The end of the coil spring 234 opposite the first rod collar 232 seats against the damper collar 224.

With the cleaning apparatus 206 in the retracted position, damper adjustment apparatus, shown here as a manually operated crank, may be actuated to move a slidable pivot 238 of the coupler 220 left or right, as viewed in the drawings, along the adjustment track 222, respectively, to lower or raise the distal end 218 of the damper, thereby regulating the air flowing through the plenum 200 into the air port. Although the presently described embodiment of the invention is shown having a manually operated damper adjustment means, it is understood that automatic means such as servomotor controlled by a computer may be utilized to reposition the damper. In FIG. 6, the damper 204 is shown in the fully open position, while in FIG. 7 the damper 204 is partially closed. The stop 230 extends the entire width of the plenum as does the coupler 220, therefore, it is seen that when the coupler 220 abuts the stop 230, air is blocked from flowing over the top of the damper 204.

Referring to FIG. 8, when a cleaning cycle is initiated by actuating the air cylinder to move the rod 212 axially toward the air port 202, the coil spring 234 forces the damper collar away from the stop 230 thereby lowering the damper 204 to the bottom of the plenum out of the way of the cleaning head 210, which is free to move from its retracted position, down and forward into the air port to clean the opening as previously described. It is seen that during a cleaning cycle an air passage 240 is provided between the coupler 220 and the stop 230, and that additional air may be supplied through an opening 242 in the top of the plenum that is closed by the cleaning head in the retracted position. The air cylinder is then reversed to move the actuating rod 212 axially away from the air port thereby returning the cleaning head to the retracted position, whereupon the coil spring relaxes sufficiently to allow the damper to return to the position it occupied prior to initiating the cleaning cycle. Upward positive movement of the damper 204 is provided by the second rod collar 236 abutting the damper collar 224 and forcing it snugly against the stop 230.

A plurality of units of the apparatus according to the present invention are ordinarily installed on a single firebox for the same boiler. The dampers may be adjusted automatically as needed by control means, not shown, responsive to furnace instrumentation to regulate the flow of combustion air entering the secondary air ports. The operation of the cleaning apparatus may likewise be timed by timing means, not shown, to be substantially completely automatic for retracting the dampers and inserting the cleaning heads periodically for quickly cleaning the air ports during furnace operation, withdrawing the cleaning heads and returning the dampers to their previous positions.

In addition to providing improved efficiency of boiler operation, the present invention enhances operating safety, not only in eliminating the need for manual cleaning and frequent adjustment of dampers to regulate air flow to compensate for clogged air ports, but also in stabilizing the char bed which reduces the danger of hot spots and boiler tube rupture.

While the principles of my invention have now been made clear in the foregoing illustrative embodiments, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. Apparatus for regulating air flow through an air port of a firebox, said apparatus comprising:

a plenum chamber having first and second openings therein, said plenum chamber receiving air under pressure through the first opening and supplying the air through the second opening to the air port;

means movably mounted in said plenum chamber between the first and second openings for damping the flow of air through said plenum chamber to the air port;

first means for selectively moving said damping means to a first position in a locus of movement of said damping means, the first position resulting in a predetermined flow of air through said plenum chamber to the air port;

means movably mounted in said plenum chamber for cleaning, during periodic cleaning cycles, excrescent material blocking the air port, said cleaning means being in a retracted position in said plenum chamber during periods between the periodic cleaning cycles, said cleaning means in the retracted position being in non-interfering relation with the locus of movement of said damping means, said cleaning means having a locus of movement that is mutually interfering with a substantial portion of the locus of movement of said damping means; and second means connected to said cleaning means and operable during the periodic cleaning cycles for moving said cleaning means into the air port to dislodge the excrescent material therefrom and to return said cleaning means to the retracted position said first moving means including means operable before starting a cleaning cycle for moving said damping means from the first position to a second position in the locus of movement of said damping means, the second position being in non-interfering relation with the locus of movement of said cleaning means, and returning said damping means to the first position after said cleaning means returns to the retracted position.

2. Apparatus for regulating the air flow through an air port of a firebox, said apparatus comprising:

a plenum chamber having first and second openings therein, said plenum chamber receiving air under pressure through the first opening and supplying the air through the second opening to the air port;

means movably mounted in said plenum chamber between the first and second openings for damping the flow of air through said plenum chamber to the air port;

first means for selectively moving said damping means to a first position in a locus of movement of said damping means, the first position resulting in a predetermined flow of air through said plenum chamber to the air port;

means movably mounted in said plenum chamber for cleaning, during periodic cleaning cycles, excrescent material blocking the air port, said cleaning means being in an at-rest position in said plenum chamber during periods between the periodic cleaning cycles, said cleaning means in the at-rest position being in non-interfering relation with the locus of movement of said damping means, said cleaning means having a locus of movement that is mutually interfering with a substantial portion of the locus of movement of said damping means; and second means connected to said cleaning means and operable during the periodic cleaning cycles for moving said cleaning means into the air port to dislodge the excrescent material therefrom and return said cleaning means to the at-rest position, said second moving means including means coupled to said damping means and operable before said cleaning means moves from the at-rest position for moving said damping means from the first position to a second position in the locus of movement of said damping means, the second position being in non-interfering relation with the locus of movement of said cleaning means, and returning said damping means to the first position after said cleaning means returns to the at-rest position.

3. In a reduction furnace provided with a plurality of air ports in a wall of the furnace and a wind box supplying combustion air under pressure through the air ports to a firebox of the furnace, means including a damper for controlling the flow of combustion air through one of the air ports, the firebox being subject to a buildup of excrescent material along an upper edge of the air ports inside the firebox, the improvement comprising:

a plenum chamber in the wind box having a first opening into the firebox through the one air port and a second opening receiving air from the wind box, a damper mounted in said plenum chamber intermediate said first and said second openings, said damper being adjustable to regulate the air flowing from the wind box through the plenum chamber to the first opening;

a cleaning head mounted on a pivot inside the plenum chamber in an at rest position above and adjacent to the first opening, said cleaning head being rotatably movable about said pivot from the at rest position in a locus of movement so as to insert a portion of said cleaning head through the first opening into the one air port and inside the firebox vertically beyond the upper edge of the one air port, said damper, when in an open position, being within the locus of movement of said cleaning head; and actuating means coupled to said cleaning head for moving said cleaning head into and subsequently out of the one air port and returning to the at-rest position, said actuating means including means coupled to said damper for moving said damper out of the locus of movement of said cleaning head prior to the movement of said cleaning head from its at-rest position, and subsequently returning said damper to the open position after said cleaning head returns to the at-rest position.

4. The apparatus according to claim 1 wherein the one air port is rectangular and said cleaning head comprises a rectangular frame sweeping the peripheral edges of the rectangular air port when said cleaning head is inserted into the air port.

5. The apparatus according to claim 1 wherein the improvement further comprises a third opening in said plenum chamber communicating with said wind box, said cleaning head when in in the at-rest position providing a closure of said third opening.

6. Apparatus for regulating air flow through an air port of a firebox, said apparatus comprising:

a plenum mounted externally of the firebox, said plenum having a first opening into the firebox through the air port and a second opening receiving air under pressure;

a cleaning element having a first hook-shaped member with first and second ends, said cleaning element being pivotally mounted toward the first end of said hook-shaped member in said plenum adjacent to said first opening, said cleaning element being adapted for movement of the second end between a retracted position and an extended position wherein the second end defines a locus sweeping inside the firebox and upwardly with respect to said first opening substantially beyond an upper edge of the air port, and said cleaning element defines a locus sweeping from an at-rest position above said first opening downward and forward into said first opening, whereby the second end of said moving cleaning element in the extended position dislodges excrescent material inside the upper edge of the air port;

means mounted in said plenum between said first opening and said second opening for damping air flowing through said plenum, said damping means being movable from a closed position wherein substantially no air flows through said plenum to an open position wherein a predetermined amount of air flows through said plenum, said damping means in the open position being within the locus of movement of said cleaning element; and actuating means affixed to said plenum for providing the movement of said cleaning element, said actuating means including means coupled to said damping means for providing movement of said damping means away from the locus of movement of said cleaning head.

7. A method for regulating the air flow through an air port of a chemical recovery furnace, the air port being subject to buildup of excrescent material from furnace operation which tends to block the flow of air through the air port opening, the furnace having a plenum supplying combustion air under pressure to the air port, the plenum having an adjustable damper and air port cleaning apparatus in the plenum, the air port cleaning apparatus having a cleaning head in a retracted position away from the air port opening and out of the way of the damper, the cleaning head being insertable into the air port opening, the method comprising the steps of:

adjusting the damper to a position which provides a predetermined air flow through the plenum into the air port; and periodically cleaning the air port of excrescent material blocking the flow of air through the air port, the cleaning step including the steps of:

retracting the damper within the plenum from the region near the air port opening;

after the damper is retracted, actuating the cleaning head from its retracted position and into the air port opening;

returning the cleaning head to its retracted position; and subsequently repositioning the damper to a position which provides the predetermined flow through the plenum and into air port.

* * * * *

UNITED STATES PATENT AND TRADEMARK OFFICE

CERTIFICATE OF CORRECTION

PATENT NO. : 4,838,182

DATED : June 13, 1989

INVENTOR(S) : BYRON L. GOODSPEED

It is certified that error appears in the above-identified patent and that said Letters Patent is hereby corrected as shown below:

Column 10, line 36, after "position" insert a comma (,).

Column 11, line 66, after "in" delete --in--.

Column 12, line 65, after "predetermined" insert --air--.

Signed and Sealed this

Seventeenth Day of September, 1991

*Attest:*

HARRY F. MANBECK, JR.

*Attesting Officer*

*Commissioner of Patents and Trademarks*